US008223979B2

(12) United States Patent
Aarts et al.

(10) Patent No.: US 8,223,979 B2
(45) Date of Patent: Jul. 17, 2012

(54) ENHANCEMENT OF SPEECH INTELLIGIBILITY IN A MOBILE COMMUNICATION DEVICE BY CONTROLLING OPERATION OF A VIBRATOR BASED ON THE BACKGROUND NOISE

(75) Inventors: Ronaldus Maria Aarts, Eindhoven (NL); Harm Jan Willem Belt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1204 days.

(21) Appl. No.: 11/997,171

(22) PCT Filed: Aug. 1, 2006

(86) PCT No.: PCT/IB2006/052615

§ 371 (c)(1),
(2), (4) Date: Jan. 29, 2008

(87) PCT Pub. No.: WO2007/015203

PCT Pub. Date: Feb. 8, 2007

(65) Prior Publication Data

US 2008/0219457 A1 Sep. 11, 2008

(30) Foreign Application Priority Data

Aug. 2, 2005 (EP) ..... 05300640

(51) Int. Cl.
*H04R 29/00* (2006.01)

(52) U.S. Cl. ..... 381/56; 381/57; 381/59

(58) Field of Classification Search ..... 381/57, 381/56, 59

See application file for complete search history.

(56) References Cited

U.S. PATENT DOCUMENTS

| | | | | |
|---|---|---|---|---|
| 4,737,976 | A * | 4/1988 | Borth et al. | 455/563 |
| 6,411,198 | B1 * | 6/2002 | Hirai et al. | 340/7.6 |
| 6,741,873 | B1 | 5/2004 | Doran et al. | |
| 2004/0168565 | A1 | 9/2004 | Nagao et al. | |
| 2004/0192210 | A1 | 9/2004 | Park | |

FOREIGN PATENT DOCUMENTS

| | | | |
|---|---|---|---|
| EP | 0767570 | A2 | 4/1997 |
| EP | 1387559 | A1 | 2/2004 |
| GB | 2394391 | A | 4/2004 |
| JP | 2003032325 | A | 1/2003 |
| WO | 9858448 | A1 | 12/1998 |

OTHER PUBLICATIONS

S. Kumar, et al: Smart Volume Tuner for Cellular Phones, IEEE Wireless Communications, vol. 11, No. 3, Jun. 2004, pp. 44-49.

Rainer Martin: Spectral Subtraction Based on Minimum Statistics, Signal Processing VII, Eusipco, Edinburgh, Sep. 1994, pp. 1182-1185.

Peter S. K. Hansen: Signal Subspace Methods for Speech Enhancement, Ph. D. Thesis, IMM, Technical University of Denmark, Sep. 30, 1997.

* cited by examiner

*Primary Examiner* — Theresa T Doan

(57) ABSTRACT

A mobile communication device includes a loudspeaker for reproducing speech from a speech signal, a vibrator, and a measuring unit for measuring background noise in relation to the reproduced speech. The communication device further includes a vibrator processing unit for generating a control signal dependent on the background noise for controlling operation of the vibrator during speech reproduction dependent on a level of the background noise.

14 Claims, 4 Drawing Sheets

ENHANCEMENT OF SPEECH INTELLIGIBILITY IN A MOBILE COMMUNICATION DEVICE BY CONTROLLING OPERATION OF A VIBRATOR BASED ON THE BACKGROUND NOISE

FIELD OF THE INVENTION

The invention relates generally to a mobile communication device and, more particularly, to a mobile communication device having means for enhancing the intelligibility of audio signals output thereby in the presence of environmental noise.

BACKGROUND OF THE INVENTION

Mobile communication devices, such as cellular telephones, have gained widespread use in virtually all metropolitan areas of the world, and a significant amount of speech communication is now performed using mobile telephones. However, due to the mobile nature of these devices, they are inherently vulnerable to use in a wide variety of acoustic environments, some of which may be noisy. Environmental noise may cause problems whether it occurs at the receiving end of a communication, the transmitting end, or a combination (to whatever extent) of the two.

It is known that background noise causes speech intelligibility to be degraded, because speech intelligibility decreases with decreasing signal to noise ratio SNR, and efforts have been made in recent years to improve speech intelligibility in adverse noise conditions. For example, U.S. Pat. No. 6,741,873 describes a mobile communication device in which a background noise level is determined at a microphone and a threshold is established. If the threshold is exceeded, it is determined to be likely that voice energy is being received at the microphone. Thus, if the input signal exceeds the threshold, the mobile communication device transmits the input signal, and the threshold varies dependent on the level of background noise.

However, this arrangement does not necessarily improve speech intelligibility in adverse noise conditions; it simply attempts to reduce the significance of the background noise relative to the speech signal according to the listener's perception, thereby increasing the likelihood of the speech being more intelligible to the listener. However, it is highly desirable to actually improve speech intelligibility in a mobile communication device so as to enhance its performance in a variety of acoustic environments.

SUMMARY OF THE INVENTION

It is therefore an object of the present invention to provide a mobile communication device in which speech intelligibility is enhanced in response to different environmental noise levels. It is also an object of the present invention to provide a corresponding method of enhancing speech intelligibility in a mobile communication device.

In accordance with the present invention, there is provided a mobile communication device comprising a loudspeaker for reproducing speech from a speech signal, a vibrator, means for measuring background noise in relation to said reproduced speech, and a vibrator processing unit for generating a control signal dependent on said background noise for controlling operation of said vibrator during speech reproduction dependent on a level of said background noise.

Beneficially, the mobile communication device comprises means for computing a background noise spectrum signal representative of the level of the background noise, the vibrator processing unit being adapted to generate the control signal so as to selectively operate the vibrator during speech reproduction based on the background noise spectrum signal. The means for measuring background noise may comprise one or more microphones and the background noise spectrum signal may be generated from an environmental noise contribution in one or more signals obtained from the one or more microphones.

According to an embodiment of the invention, said background noise spectrum signal is estimated from a single microphone signal. According to another embodiment of the invention, said background noise spectrum signal is estimated from multiple microphone signals.

The mobile communication device may further comprise a low pass filter for filtering said speech signal and an amplifier for multiplying said filtered speech signal by a gain value dependent on said background noise spectrum signal to generate said control signal. In addition, it may comprise means for integrating said background noise spectrum across a plurality of frequencies to obtain an instantaneous value related to noise power, and means for translating said instantaneous value to said gain value by applying a predetermined transfer function.

The present invention extends to a method of enhancing intelligibility of speech reproduced by a mobile communication device from a speech signal, said mobile communication device comprising a vibrator the method comprising determining background noise in relation to said reproduced speech, generating a control signal dependent on said background noise, and applying said control signal to said vibrator so as to selectively operate said vibrator during speech reproduction dependent on the level of said background noise.

These and other aspects of the present invention will be apparent from, and elucidated with reference to, the embodiments described herein.

BRIEF DESCRIPTION OF THE DRAWINGS

Embodiments of the present invention will now be described by way of examples only and with reference to the accompanying drawings, in which.

DETAILED DESCRIPTION OF THE INVENTION

The present invention provides a method and means for enhancing speech intelligibility in a mobile communication device by using a vibrator or shaker in conjunction with the loudspeaker during speech reproduction. A vibrator is in most mobile telephones already available for use in alerting a user to incoming calls and messages, either alone in silent mode, or in conjunction with a selected ring tone. In the present invention, the vibrator is caused to vibrate in a controlled manner simultaneously with the normal activity of the device loudspeaker by processing the low frequency part of the speech signal and feeding it to the vibrator, wherein this processing is such that for different environmental noise levels the speech intelligibility is optimal.

Figure 1:
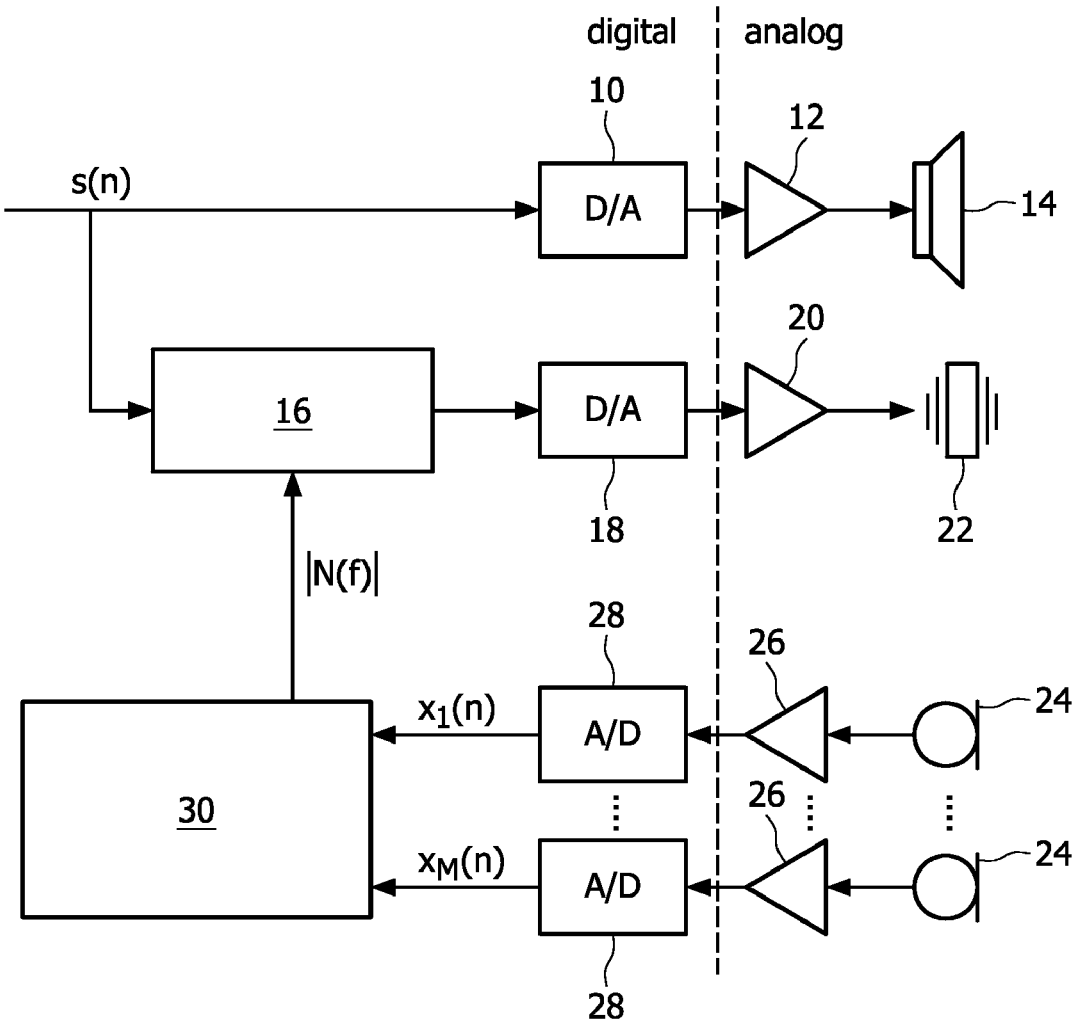
FIG. 1 is a schematic block diagram illustrating the principal components of a mobile communication device according to an exemplary embodiment of the present invention.

Referring to FIG. 1 of the drawings, the input signal s(n) represents the digital speech signal required to be reproduced. A first digital-to-analog D/A converter 10 converts the digital signal s(n) to the analog domain, following which, the analog signal is amplified by a speaker amplifier 12 and fed to a loudspeaker 14 for output. The same digital signal s(n) is processed by a vibrator processing unit 16, and the processed vibrator signal is converted to the analog domain by a second D/A converter 18, before being amplified by a vibrator amplifier 20 and fed to a vibrator 22. The vibrator processing unit 16 employs a vibrator processing algorithm which is driven by the measured environmental noise in such a way that a larger output is achieved for larger noise levels. The environmental noise is measured using signals coming from a bank of M microphones 24, where M is an integer equal to or higher than 1, which signals are amplified by respective microphone amplifiers 26 and converted to the digital domain by respective analog-to-digital A/D converters 28. From the M converted microphone signals $x_1(n)$ to $x_M(n)$, the spectrum of the environmental noise is calculated by a background noise spectrum processing unit 30 (e.g. a digital signal processor), and a noise spectrum signal $|N(f)|$ is fed to the vibrator processing unit 16 for use by the vibrator processing algorithm in generating the vibrator signal.

It will be appreciated that instead of the D/A converter in the arrangement of FIG. 1, an on-off signal may be generated by means that may be provided in the vibration processing unit 16, for example, and the present invention is not intended to be limited in this regard. Furthermore, although only one vibrator 22 is shown, a plurality of vibrators may be provided, for example, in respect of different frequency ranges, and the present invention is not intended to be limited in this regard.

Figure 2:
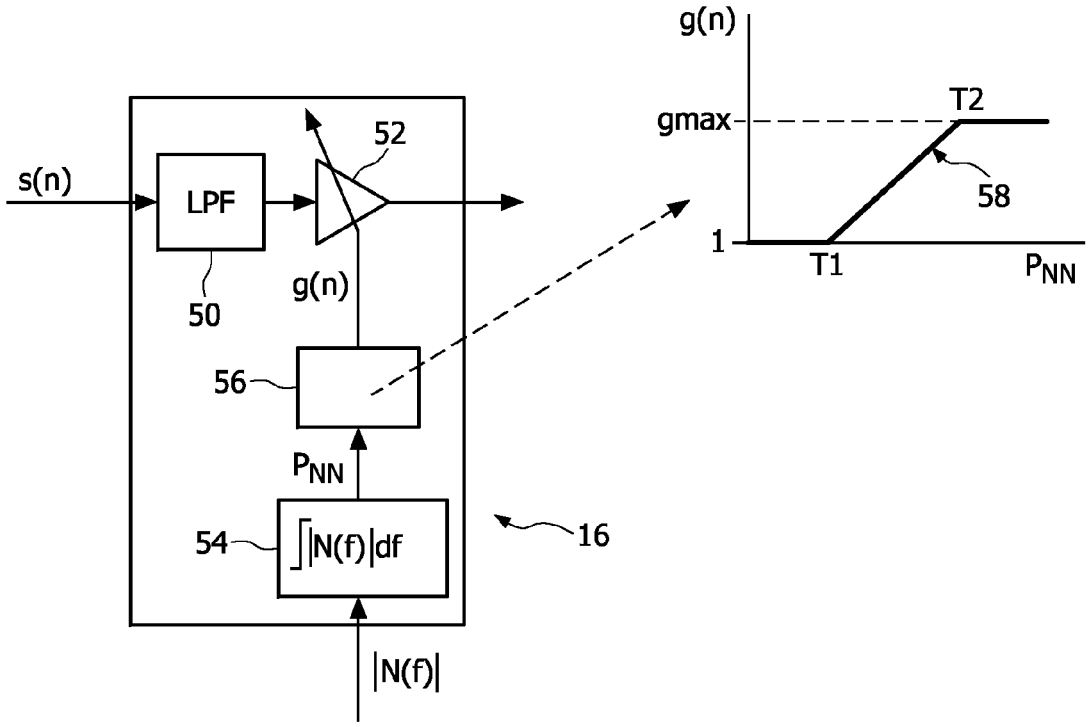
FIG. 2 is a schematic diagram illustrating the principal components of the vibrator processing block of FIG. 1.

Referring to FIG. 2 of the drawings, the principal components of the vibrator processing block 16, for producing from the loudspeaker signal s(n) a signal to control the vibrator 22, are shown in more detail. The digital loudspeaker signal s(n) is filtered by a low-pass filter LPF 50. A suitable filter has a transfer function in the z-domain given by $(1-a)*z/(z-a)$, where a is a parameter which lies in the range $0<a<1$. The low-pass filtered signal is multiplied thanks to a variable amplifier 52 by a gain g(n), and the resulting signal is used to control the current that is fed through the vibrator 22. In this exemplary embodiment, the gain g(n) is calculated from the noise magnitude spectrum $|N(f)|$, as follows. First, the noise spectrum is integrated across all frequencies via an integrator 54 to get an instantaneous value $P_{NN}$ that is related with a square root relation to the noise power (i.e. $P_{NN}$ is representative of the square root of the noise power). Note that the noise power can also be calculated by integration of $|N(f)|^2$, but such calculation requires multiplications and there is not necessarily any great advantage in doing this, for the purposes of the present invention.

$P_{NN}$ is then translated into a gain number g(n) by means of a processing unit 56 which is able to compute a transfer function 58 as shown in FIG. 2. For low values of the noise power (i.e. $P_{NN}$ lower than a first threshold T1), the vibrator 22 is not needed to enhance speech intelligibility, and hence g(n) is set to unity. Above a certain noise level (i.e. $P_{NN}$ higher than the first threshold T1), the vibrator is needed to an increasing extent as the noise increases, and hence g(n) is increased with increasing $P_{NN}$. At the highest levels of environmental noise (i.e. $P_{NN}$ higher than a second threshold T2), the gain g(n) is limited bythe physical limitations of the vibration system.

The microphone signals are composed of environmental noise and speech contributions, and single-microphone or multi-microphone environmental noise spectrum estimation may be employed in the present invention to estimate the environmental noise magnitude spectrum $|N(f)|$.

Figure 3:
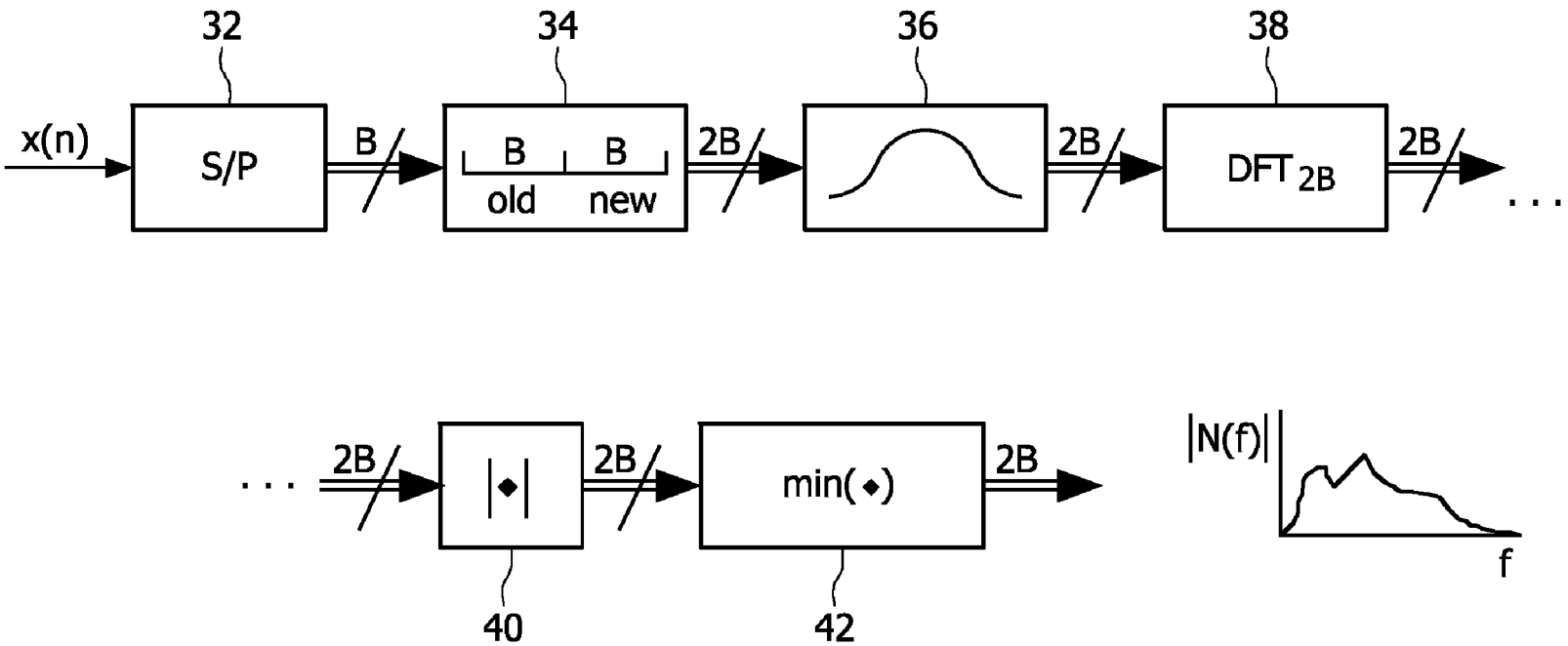
FIG. 3 is a schematic block diagram illustrating the principal steps in a single-microphone environmental noise spectrum estimation process for use in a speech intelligibility enhancement method according to an exemplary embodiment of the present invention.

Referring to FIG. 3 of the drawings, the principal steps employed in single-microphone noise spectrum estimation are shown schematically, wherein the magnitude spectrum $|N(f)|$ of the environmental noise from the microphone signal x(n) can be estimated based on the spectral minimum statistics, as described by Reiner Martin in "Spectral subtraction based on minimum statistics", Signal Processing VII, Proc. EUSIPCO, Edinburgh, September 1994, pp. 1182-1185, where n is the sampling index and f is the frequency index. First, the digitized microphone signal x(n) is split up in time in blocks of B consecutive samples by a serial-to-parallel converter in step 32. Next, and old block of B samples and a new block of B samples are concatenated in step 34 and the resulting block of 2B consecutive samples is multiplied by a Hanning window in step 36. The windowed signal is transformed to the complex-valued Fourier domain by a Discrete Fourier Transform DFT in step 38 and the magnitude of the microphone signal is then determined by taking the magnitude (i.e. absolute value) of the complex values of the DFT result for each frequency in step 40. Finally, at each frequency, a minimum search is performed in step 42 over limited past time to arrive at the estimated noise magnitude spectrum $|N(f)|$. This method finds quasi-stationary noises, where quasi-stationary means that the spectral properties change only slowly over time.

Figure 4:
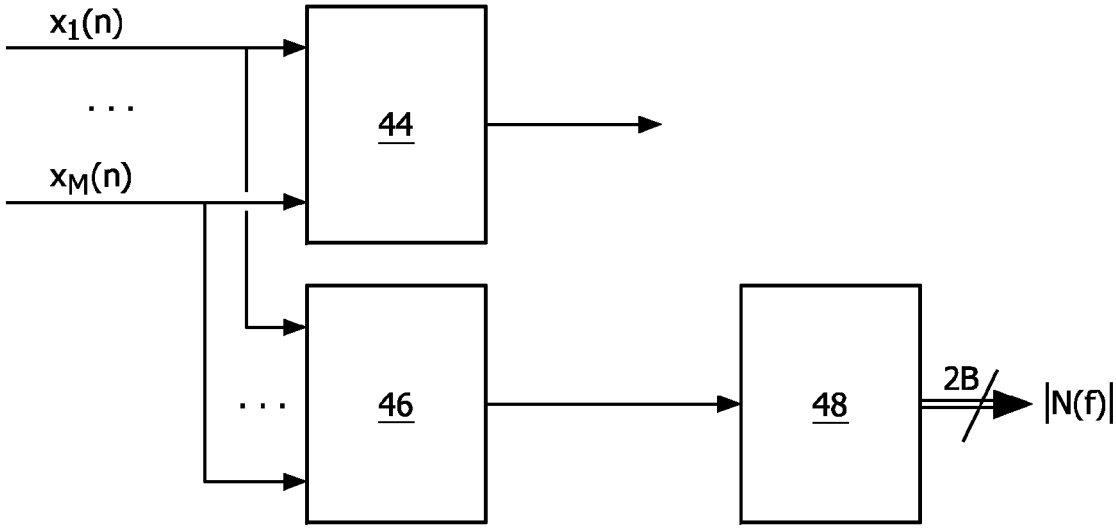
FIG. 4 is a schematic block diagram illustrating the principal steps in a multi-microphone environmental noise spectrum estimation process for use in a speech intelligibility enhancement method according to an exemplary embodiment of the present invention.

Referring to FIG. 4 of the drawings, the principal steps employed in multi-microphone noise spectrum estimation are shown schematically, wherein beam-forming technology is employed to estimate the spectrum $|N(f)|$ of the environmental noise. This technology separates the environmental noise from speech based on spatial selectivity, as described in, for example, Peter S. K. Hansen, "Signal subspace methods for speech enhancement", Ph.D. thesis, Technical University of Denmark, 1997. Thus, in this case, the M digitized microphone signals $x_1(n)$ to $x_M(n)$ are filtered by a filter matrix 44 in order to extract from the signal space spanned by $x_1(n)$ to $x_M(n)$ only the component that comes from the direction in which the user is expected to be talking (e.g. directly in front of the microphones). As a result, the speech-to-noise ratio in the output of the filter matrix 44 is larger than on any of the M microphones. An exemplary design for the filter matrix 44 is given in the above-mentioned reference by Peter S. K. Hansen. Of course, in the case of the present invention, it is not the enhanced speech that is of interest, but rather the environmental noise. From the filter matrix output, it is possible to calculate a blocking filter matrix 46 that blocks signals coming from the direction of the user and passes all other signals. The result is a signal which is representative of the environmental noise. In order to obtain the noise magnitude spectrum $|N(f)|$, the signal is windowed, transformed to the frequency domain by DFT and finally, for each frequency, the absolute value is taken, these operations being represented in combination by step 48. An exemplary design for the blocking filter matrix 46 is also given in the above-mentioned reference by Peter S. K. Hansen.

The advantage of the multi-microphone method described with reference to FIG. 3, compared with the single-microphone method described with reference to FIG. 2, is that not only quasi-stationary, but also non-stationary, environmental noise contributions are measured.

It will be appreciated that speech intelligibility in a mobile communication device according to the present invention could be further enhanced by visual cues using, for example, speech to animation technology which converts human speech to an animated film representative thereof. A real-time speech recognition engine converts human speech to phonemes, which are the basic or atomic building blocks of human speech. An animation package takes and displays the appropriate facial gestures and visual signs of each phoneme, in real time, to create a sort of animated film with a negligible delay, which is fully synchronized with the speaker's voice. Alternatively, or in addition, the words themselves may be generated and displayed substantially in real-time.

It will also be appreciated that the present invention is intended for, but not necessarily limited to, mobile telephones.

It should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa.

The invention may be implemented by means of hardware comprising several distinct elements, and by means of a suitably programmed computer. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A mobile communication device comprising:

a loudspeaker for reproduction of speech from a speech signal;

a vibrator;

a detector for measuring background noise in relation to said reproduced speech; and a vibrator processing unit for controlling operation of said vibrator during the speech reproduction based on a level of said background noise.

2. The mobile communication device according to claim 1, further comprising a processor for computing a background noise spectrum signal representative of the level of the background noise, the vibrator processing unit being configured to generate a control signal to selectively operate the vibrator during the speech reproduction based on the background noise spectrum signal.

3. The mobile communication device according to claim 2, wherein the detector comprises one or more microphones and wherein the background noise spectrum signal is generated from an environmental noise contribution in one or more signals obtained from the one or more microphones.

4. The mobile communication device according to claim 3, wherein said background noise spectrum signal is estimated from a single microphone signal.

5. The mobile communication device according to claim 3, wherein said background noise spectrum signal is estimated from multiple microphone signals.

6. The mobile communication device according to claim 2, further comprising a low pass filter for filtering said speech signal and an amplifier for multiplying said filtered speech signal by a gain value dependent on said background noise spectrum signal to generate said control signal.

7. The mobile communication device according to claim 6, further comprising integrator for integrating said background noise spectrum across a plurality of frequencies to obtain an instantaneous value related to noise power, and a translator for translating said instantaneous value to said gain value by applying a predetermined transfer function.

8. The mobile communication device of claim 1, wherein the vibrator processing unit comprises a translator configured to translate different noise levels of the measured background noise to different gain values applied to a variable amplifier for variably amplifying the speech signal for outputting a control signal having different values that are based on the different noise levels.

9. The mobile communication device of claim 8, wherein the translator is configured to translate the different noise levels of the measured background noise to the different gain values based on an increasing linear function.

10. The mobile communication device of claim 8, wherein the vibrator processing unit further comprises a filter for filtering the speech signal and providing a filtered speech signal for amplification by the variable amplifier.

11. A method of enhancing intelligibility of speech reproduced by a mobile communication device from a speech signal, said mobile communication device comprising a vibrator, the method comprising the acts of:

determining background noise in relation to said reproduced speech;

generating a control signal dependent on said background noise; and applying said control signal to said vibrator so as to selectively operate said vibrator during speech reproduction based on a level of said determined background noise so that the control signal has different values for driving the vibrator at different vibration levels for different noise levels of said determined background noise.

12. The method of claim 1, wherein the generating act increases a value of the control signal for driving the vibrator at a larger vibration level in response to an increase in the level of the determined background noise.

13. The method of claim 11, wherein the generating act includes the act of translating the different noise levels of the determined background noise to different gain values applied to a variable amplifier for variably amplifying the speech signal for outputting the different values of the control signal.

14. The method of claim 13, wherein the translating act translates the different noise levels of the determined background noise to the different gain values based on an increasing linear function.

* * * * *